US009754330B2

(12) United States Patent
Kitagishi

(10) Patent No.: US 9,754,330 B2
(45) Date of Patent: Sep. 5, 2017

(54) ELECTRIC POWER RETAIL MANAGEMENT APPARATUS AND METHOD, FOR GENERATORS AND CUSTOMER FACILITIES EXISTING IN AN AREA INCLUDING A PLURALITY OF REGIONS

(71) Applicant: YAHOO JAPAN CORPORATION, Tokyo (JP)

(72) Inventor: Ikuo Kitagishi, Tokyo (JP)

(73) Assignee: YAHOO JAPAN CORPORATION, Tokyo (JP)

( * ) Notice: Subject to any disclaimer, the term of this patent is extended or adjusted under 35 U.S.C. 154(b) by 560 days.

(21) Appl. No.: 14/303,148

(22) Filed: Jun. 12, 2014

(65) Prior Publication Data

US 2014/0379159 A1 Dec. 25, 2014

(30) Foreign Application Priority Data

Jun. 20, 2013 (JP) ..... 2013-129751

(51) Int. Cl.
*G06Q 50/06* (2012.01)

(52) U.S. Cl.
CPC ..... *G06Q 50/06* (2013.01)

(58) Field of Classification Search
CPC . G06Q 50/06; G01R 21/00; H02J 3/06; H02J 3/38; H02J 3/381; G06G 7/635;
(Continued)

(56) References Cited

U.S. PATENT DOCUMENTS

2005/0209951 A1* 9/2005 Aron ..... G06Q 30/06 705/37
2011/0035076 A1* 2/2011 Schweitzer, III ... H02J 13/0062 700/296

(Continued)

FOREIGN PATENT DOCUMENTS

JP A-2002-123578 4/2002
JP 2003-199255 A 7/2003
JP 2003-304642 A 10/2003

OTHER PUBLICATIONS

Nov. 4, 2014 Office Action issued in Japanese Application No. 2013-129751.

(Continued)

*Primary Examiner* — M. N. Von Buhr
(74) *Attorney, Agent, or Firm* — Oliff PLC

(57) ABSTRACT

An electric power retail management apparatus according to an embodiment includes an adjustment parameter calculating unit and an adjustment parameter transmitting unit. The adjustment parameter calculating unit calculates a total electric power adjustment parameter, which balances electric power generation amounts of power generators and the electric power consumption amounts of electric power customers, for each of the electric power generators on the basis of conditions of the electric power generation amounts of the electric power generators and the electric power consumption amounts of the electric power customers existing in a single region. The adjustment parameter transmitting unit transmits the total electric power adjustment parameters to the electric power generators.

10 Claims, 5 Drawing Sheets

(58) Field of Classification Search
CPC ..... Y02E 40/70; Y02E 40/72; Y04S 10/00; Y04S 10/10; Y04S 10/12; Y04S 10/54; Y04S 20/00; Y04S 20/10; Y04S 20/12; Y04S 20/20; Y04S 20/22; Y04S 20/221; Y04S 50/00; Y04S 50/10; Y04S 50/12
See application file for complete search history.

(56) References Cited

U.S. PATENT DOCUMENTS

2011/0112703 A1* 5/2011 Lundberg ..... G06Q 10/00 700/297
2011/0208637 A1* 8/2011 Wakita ..... H04L 63/0823 705/37
2011/0231028 A1* 9/2011 Ozog ..... G06Q 10/06 700/291
2012/0083930 A1* 4/2012 Ilic ..... G06Q 30/06 700/287
2012/0229077 A1* 9/2012 Tsuchiya ..... H02J 3/32 320/107
2012/0326503 A1* 12/2012 Birkelund ..... G06Q 10/04 307/24
2013/0015703 A1* 1/2013 Rouse ..... H02J 3/38 307/18
2013/0158932 A1* 6/2013 Witter ..... G06Q 10/063118 702/108
2014/0025218 A1* 1/2014 Nishi ..... H02J 3/06 700/295
2014/0188689 A1* 7/2014 Kalsi ..... G06Q 40/04 705/37
2014/0214219 A1* 7/2014 Katayama ..... G06Q 50/06 700/291
2014/0288720 A1* 9/2014 Stewart ..... H02J 3/14 700/295
2014/0375126 A1* 12/2014 Kitagishi ..... G06Q 30/06 307/29
2015/0100172 A1* 4/2015 Forbes, Jr. ..... H02J 3/32 700/295
2015/0142802 A1* 5/2015 Alkadi ..... G06F 17/30563 707/737
2015/0149249 A1* 5/2015 Mansfield ..... G06Q 30/0205 705/7.31
2015/0149256 A1* 5/2015 Forbes, Jr. ..... G05D 17/00 705/7.35
2015/0251548 A1* 9/2015 Sortomme ..... H02J 7/00 320/109
2015/0261240 A1* 9/2015 Mokhtari ..... H02J 3/381 700/291
2016/0072289 A1* 3/2016 Lazaris ..... G06Q 30/0605 700/287
2016/0178678 A1* 6/2016 Pelletier ..... B60L 11/1842 705/39
2016/0320435 A1* 11/2016 Budhraja ..... H02J 3/008

OTHER PUBLICATIONS

Feb. 24, 2015 Office Action issued in Japanese Patent Application No. 2013-129751.

* cited by examiner

SELECTION INFORMATION TABLE

| USER ID | CONTRACT CAPACITY | CONTRACT TYPE | REGION |
|---|---|---|---|
| U101 | 10 AMPERES | ONLY SOLAR POWER GENERATION | EA |
| U102 | 30 AMPERES | ONLY NATURAL ENERGY | EA |
| U103 | 20 AMPERES | 50 % OF NATURAL ENERGY AND 50 % OF THERMAL POWER GENERATION | EB |
| U104 | 40 AMPERES | ELECTRIC POWER CHARGE PLAN A | EB |
| ⋮ | ⋮ | ⋮ | ⋮ |

FIG.5

ELECTRIC POWER CONSUMPTION AMOUNT TABLE

| USER ID | THIS-TIME ELECTRIC POWER CONSUMPTION AMOUNT | LAST ELECTRIC POWER CONSUMPTION AMOUNT | ... |
|---|---|---|---|
| U101 | 235 Wh | 363 Wh | ... |
| U102 | 652 Wh | 1052 Wh | ... |
| U103 | 352 Wh | 894 Wh | ... |
| U104 | 753 Wh | 1205 Wh | ... |
| ⋮ | ⋮ | ⋮ | ⋮ |

FIG.6

ELECTRIC POWER GENERATION AMOUNT TABLE

| ELECTRIC POWER GENERATOR ID | POWER PRODUCER | REGION | TYPE OF ELECTRIC POWER GENERATOR | CONTRACT ELECTRIC POWER GENERATION AMOUNT (MW/h) | ELECTRIC POWER GENERATION AMOUNT (MW/h) | MAXIMUM ELECTRIC POWER GENERATION AMOUNT (MW/h) | ELECTRIC POWER GENERATION CHARGE (kW/h) |
|---|---|---|---|---|---|---|---|
| E101 | CE1 | EA | SOLAR POWER GENERATION | 1 TO 2 | 2 | 1.8 | ¥30 |
| E102 | CE1 | EA | WIND POWER GENERATION | 2 TO 3 | 2.4 | 3 | ¥21 |
| E103 | CE1 | EA | HYDRAULIC POWER GENERATION (NON-PUMPING) | 30 TO 40 | 35 | 36 | ¥12 |
| E104 | CE2 | EA | THERMAL POWER GENERATION (NATURAL GAS) | 500 TO 600 | 576 | 600 | ¥7 |
| E105 | CE3 | EB | NUCLEAR POWER GENERATION | 1200 TO 1500 | 1205 | 1600 | ¥4 |
| E106 | CE4 | EB | SOLAR POWER GENERATION | 3 TO 4 | 3.9 | 4.5 | ¥35 |
| E107 | CE4 | EB | HYDRAULIC POWER GENERATION (PUMPING) | 2 TO 3 | 2.5 | 3.5 | ¥12 |
| E108 | CE4 | EB | SOLAR POWER GENERATION | 0.5 TO 0.8 | 0.4 | 0.4 | ¥33 |
| E109 | CE5 | EB | THERMAL POWER GENERATION (PETROLEUM) | 500 TO 600 | 569 | 600 | ¥15 |
| E110 | CE5 | EC | THERMAL POWER GENERATION (COAL) | 200 TO 300 | 225 | 300 | ¥5 |
| ⋮ | ⋮ | ⋮ | ⋮ | ⋮ | ⋮ | ⋮ | ⋮ |

ELECTRIC POWER RETAIL MANAGEMENT APPARATUS AND METHOD, FOR GENERATORS AND CUSTOMER FACILITIES EXISTING IN AN AREA INCLUDING A PLURALITY OF REGIONS

CROSS-REFERENCE TO RELATED APPLICATIONS

The present application claims priority to and incorporates by reference the entire contents of Japanese Patent Application No. 2013-129751 filed in Japan on Jun. 20, 2013.

BACKGROUND OF THE INVENTION

1. Field of the Invention

The present invention relates to an electric power retail management apparatus and an electric power retailing management method.

2. Description of the Related Art

Although electric power supply to electric power customers has been monopolized by electric power companies, electric power retailers have became enabled to participate in electric power supply along with an amendment to the Electricity Business Act. When supplying electric power for retail purchased from a power producer to a plurality of contracted electric power customers, the electric power retailers must adjust an electric power supply amount so as to balance supply and demand. However, unexpected fluctuations in demand may occur.

In view of the above, an electric power retailing system has been developed that performs adjustment of demand and supply so as to be able to respond to unexpected fluctuations in demand on a certain day and ensures electric power necessary for supply to electric power customers (refer to Japanese Patent Application Laid-open No. 2002-123578, for example).

To operate retailing business on a large scale, electric power retailers need a larger amount of electric power for retail. This requires them to acquire electric power for retail from different electric power generators existing in different regions, which, may cause a problem of an electric power transmission-distribution path depending on the positional relation between the electric power generators and electric power customers.

When the path between a power generator of a power producer and an electric power customer is long, for example, the path spreads across electric power transmission-distribution networks of different electric power companies, thereby increasing the cost of electric power transmission-distribution or causing electric power transmission-distribution loss.

SUMMARY OF THE INVENTION

An electric power retail management apparatus according to an embodiment includes an electric power generation amount information acquisition unit, a consumption amount information acquisition unit, an adjustment parameter calculating unit, and an adjustment parameter transmitting unit. The electric power generation amount information acquisition unit acquires, as information on an electric power generation amount, information on an amount of electric power supplied from each of power generators of power producers to an electric power transmission-distribution network. The consumption amount information acquisition unit acquires, as information on an electric power consumption amount, information on an amount of electric power supplied from the electric power transmission-distribution network to each of electric power customers. The adjustment parameter calculating unit calculates a total electric power adjustment parameter, which balances the electric power generation amounts and the electric power consumption amounts, for each of the electric power generators on the basis of conditions of the electric power generation amounts of the electric power generators and the electric power consumption amounts of the electric power customers existing in a single region. The adjustment parameter transmitting unit transmits the total electric power adjustment parameters to the electric power generators.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 5 is a diagram illustrating an example of an electric power consumption amount table;

FIG. 6 is a diagram illustrating an example of an electric power generation amount table.

DETAILED DESCRIPTION OF THE PREFERRED EMBODIMENTS

The following describes embodiments of an electric power retail management apparatus and an electric power retailing management method according to the present application in detail with reference to the drawings. The embodiments do not limit the electric power retail management apparatus and the electric power retailing management method according to the present application.

1. Electric Power Retailing Management Processing

Figure 1A:
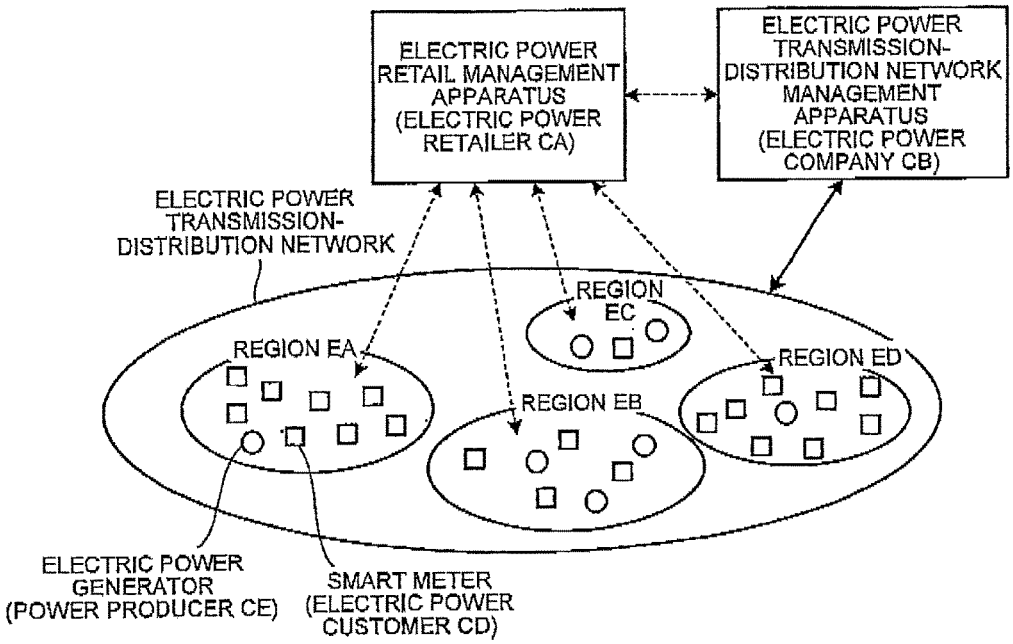
FIGS. 1A and 1B are illustrative diagrams illustrating electric power retailing management processing according to an embodiment.

Described first is electric power retailing management processing according to an embodiment. FIG. 1A is an illustrative diagram illustrating electric power retailing management processing according to the embodiment. In the present embodiment, an electric power retailing system performs the electric power retailing management processing.

As illustrated in FIG. 1A, the electric power retailing system according to the embodiment includes a plurality of electric power generators, a plurality of smart meters, and an electric power retail management apparatus. The electric power generators, the smart meters, and the electric power retail management apparatus are connected to each other via a communication network or a dedicated line.

An electric power company CB manages and operates an electric power transmission-distribution network and an electric power transmission-distribution network management apparatus. The electric power transmission-distribution network management apparatus manages the electric power transmission-distribution network. An electric power retailer CA manages and operates the electric power retail management apparatus. The electric power retailer CA makes a purchase contract for generated electric power with a plurality of power producers CE in advance. The electric power retailer CA makes an electric power retailing contract with a plurality of electric power customers CD in advance. The electric power retail management apparatus provides generated electric power supplied from the respective electric power generators of the power producers CE to the electric power customers CD via the electric power transmission-distribution network of the electric power company CB.

The smart meters are provided in respective houses or facilities of the electric power customers CD. These smart meters detect electric power consumption amounts of the respective electric power customers CD and transmit information on such electric power consumption amounts to the electric power retail management apparatus via the communication network. The electric power consumption amount is an electric power amount consumed by the electric power customer CD, that is, an electric power amount supplied from the electric power transmission-distribution network to the facility of the electric power customer CD.

The electric power retail management apparatus receives information on electric power generation amounts of the respective electric power generators from the respective electric power generators via the communication network. The electric power generation amount is an electric power amount supplied from the electric power generators to the electric power transmission-distribution network by the control of the electric power retail management apparatus. The respective electric power generators acquire total electric power adjustment parameters from the electric power retail, management apparatus via the communication network to control the electric power generation amounts to be output from the respective electric power generators to the electric power transmission-distribution network so as to give electric power generation amounts corresponding to the total electric power adjustment parameters.

Figure 1B:
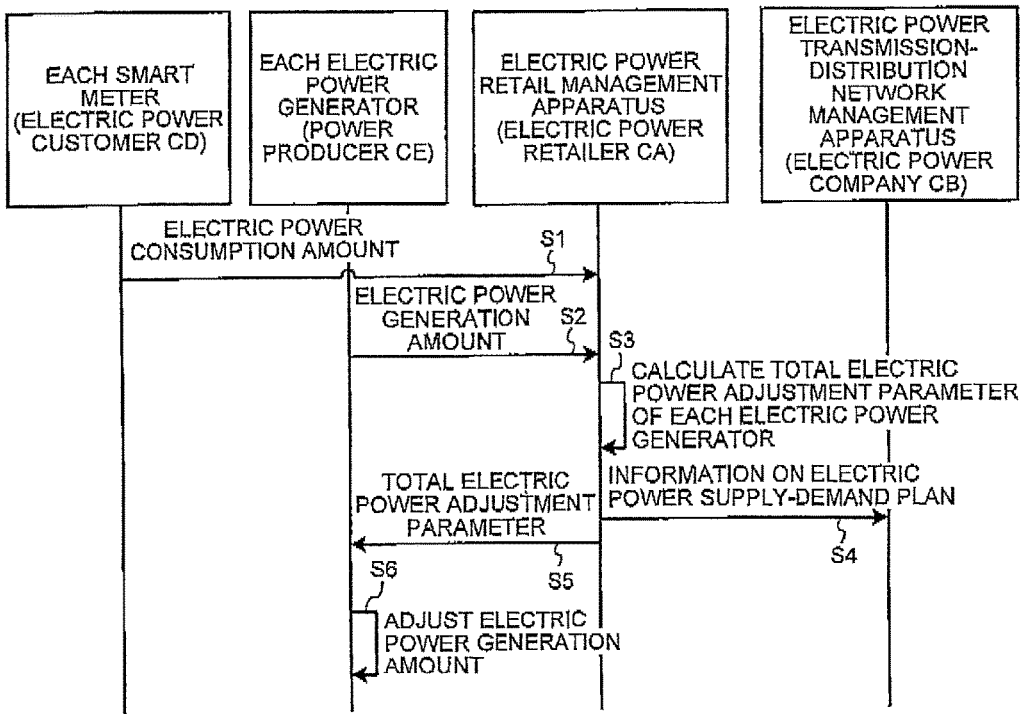

Described with reference to FIG. 1B is a flow of an electric power retailing management method performed by the thus configured electric power retiling system. FIG. 1B is an illustrative diagram illustrating electric power retailing management processing according to the embodiment. As illustrated in FIG. 1B, each smart meter transmits information on an electric power consumption amount by each electric power customer CD via the communication network (Step S1). Each electric power generator transmits an electric power generation amount to the electric power retail management apparatus via the communication network (Step S2).

The electric power retail management apparatus calculates a total electric power adjustment parameter for each electric power generator on the basis of information on each region EA to ED (hereinafter may be collectively referred to as a region E) (Step S3). In the processing, the electric power retail management apparatus calculates an electric power generation amount for each electric power generator for balancing the total amount of the electric power generation amounts and the total amount of the electric power consumption amounts on the basis of the conditions of the electric power consumption amounts of the electric power customers CD and the electric power generation amounts of the electric power generators of each region, thereby creating an electric power supply-demand plan and determining the total electric power adjustment parameter for each electric power generator.

For example, the electric power retail management apparatus associates the electric power consumption amount of the electric power customers CD with the electric power generation amount of the electric power generators existing in the same region for each region E. When the electric power generation amount is short, the electric power retail management apparatus associates, the shortage of the electric power generation amount with the electric power generation amount of an electric power generator existing in another region. In this case, the electric power retail management apparatus selects a region, as the other region, that is the closest to the region in which the electric power generation amount is short and that has an electric power generator that can supply an electric power generation amount. For example, the electric power retail management apparatus selects a region giving a less number of times of crossing connecting points between electric power transmission-distribution networks of different electric power companies as the other region or selects a region having the smallest length of an electric power transmission-distribution path as the other region.

Thus, the electric power retail management apparatus associates supply with demand preferentially for the electric power customers CD and the electric power generators in the same region, associates the electric power generator that is regionally close with the electric power customers CD for the shortage of the electric power generation amount, creates the electric power supply-demand plan, and determines the total electric power adjustment parameter for each electric power generator.

When the type of the electric power generator is selected by the electric power customer CD, the electric power retail management apparatus further calculates the electric power generation amount of each electric power generator on the basis of the conditions of the electric power generation amount and the electric power consumption amount of each region E corresponding to the type of the electric power generator selected by the electric power customer CD, thereby creating the electric power supply-demand plan and determining the total electric power adjustment parameter for each electric power generator.

Next, the electric power retail management apparatus transmits information on the created electric power supply-demand plan to the electric power transmission-distribution network management apparatus via the communication network (Step S4). The information on the electric power supply-demand plan is information indicating a schedule of an electric power generation amount to be supplied to the electric power transmission-distribution network and an electric power consumption amount from the electric power transmission-distribution network in a given period TA (e.g., 30 minutes).

The electric power retail management apparatus transmits the calculated total electric power adjustment parameters to the respective electric power generators via the communication network (Step S5). Each electric power generator adjusts the electric power generation amount to be supplied to the electric power transmission-distribution network on the basis of the total electric power adjustment parameter (Step S6).

Thus, the electric power retailing management processing according to the embodiment calculates the total electric power adjustment parameter for each electric power generator on the basis of the conditions of the electric power consumption amount of the electric power customers CD in each region and the electric power generation amount of the electric power, generators in each region. This causes the electric power retailing management processing to manage the electric power transmission-distribution path appropriately while performing balancing control (for example, simultaneous commensurate control). It can reduce the lengthening of the electric power transmission-distribution path between the electric power generators and the electric power customers CD, for example. It also can reduce spreading across the electric power transmission-distribution networks of different electric power companies CB, thereby reducing an increase in the cost of electric power transmission-distribution and reducing electric power transmission-distribution loss.

2. Electric Power System 1

Figure 2:
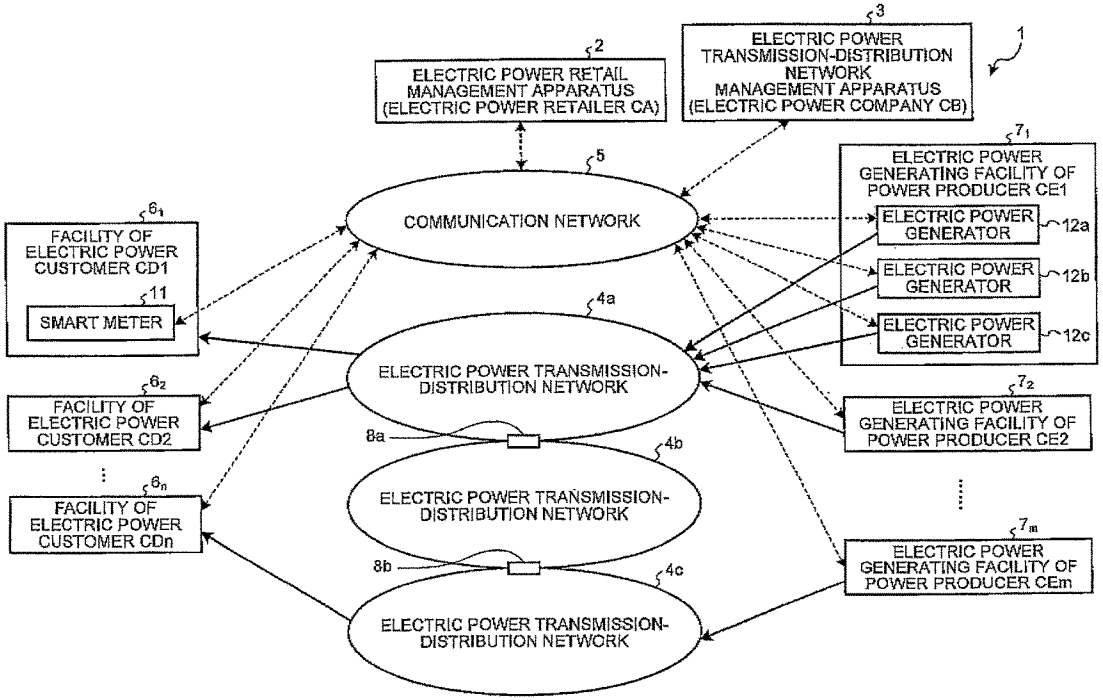
FIG. 2 is a diagram illustrating an example of the configuration of an electric power system according to the embodiment.

Next, an electric power system according to the embodiment is described further with reference to FIG. 2. As illustrated in FIG. 2, this electric power system 1 includes an electric power retail management apparatus 2, an electric power transmission-distribution network management apparatus 3, electric power transmission-distribution networks 4*a* to 4*c*, a communication network 5, facilities $\mathbf{6}_1$ to $\mathbf{6}_n$ (hereinafter denoted as electric power customer facilities $\mathbf{6}_1$ to $\mathbf{6}_n$) of electric power customers CD1 to CDn, and electric power generating facilities $\mathbf{7}_1$ to $\mathbf{7}_n$ of power producers CE1 to CEm.

The electric power company CB manages and operates the electric power transmission-distribution network management apparatus 3 and the electric power transmission-distribution networks 4*a* to 4*c*. For example, the electric power transmission-distribution networks 4*a* to 4*c* are connected to facilities (not illustrated) of electric power customers who have contracted with the electric power company CB and electric power generators (not illustrated) of the electric power company CB and manages electric power supply and demand therebetween.

The electric power transmission-distribution network 4*a* and the electric power transmission-distribution network 4*b* are connected via a connecting device 8*a*, whereas the electric power transmission-distribution network 4*b* and the electric power transmission-distribution network 4*c* are connected via a connecting device 8*b*. Different electric power companies CB may manage and operate the electric power transmission-distribution networks 4*a* to 4*c* (hereinafter may be collectively referred to as an electric power transmission-distribution network 4). In this case, different apparatuses 3 for Managing electric power transmission-distribution network manage the electric power transmission-distribution networks 4*a* to 4*c*.

The electric power transmission-distribution network management apparatus 3 acquires information on the electric power supply-demand plan from the electric power retail management apparatus 2 and gives permission for the electric power supply-demand plan. When electric power supply and demand in accordance with the permitted electric power supply-demand plan is not performed, the electric power transmission-distribution network management apparatus 3 compensates for an insufficiently supplied electric power generation amount with an electric power generation amount of the electric power generator of the electric power company CB and charges an extra electric power charge or a penalty to the electric power retailer CA. The electric power transmission-distribution network management apparatus 3 calculates an electric power transmission-distribution charge for the electric power retailer CA on the basis of the electric power supply-demand plan. When there is any electric power generation amount transmitted and distributed crossing the connecting devices 8*a*, 8*b*, the electric power transmission-distribution network management apparatus 3 calculates an electric power transmission-distribution charge with an extra charge added every time it crosses the connecting devices 8*a*, 8*b*, and charges the calculated electric power transmission-distribution charge to the electric power retailer CA.

Each of the electric power customer facilities $\mathbf{6}_1$ to $\mathbf{6}_n$ (hereinafter may be collectively referred to as an electric power customer facility 6) has a smart meter 11. Each smart meter 11 measures an electric power consumption amount of each electric power customer facility 6, and information on the electric power consumption amount measured by each smart meter 11 is transmitted to the electric power retail management apparatus 2 via the communication network 5.

Each of the electric power generating facilities $\mathbf{7}_1$ to $\mathbf{7}_n$ has one or more electric power generators. For example, the electric power generating facility $\mathbf{7}_1$ has three electric power generators 12*a* to 12*c* (hereinafter may be collectively referred to as an electric power generator 12). Examples of the type of the electric power generator 12 may include solar power generation, wind power generation, geothermal power generation, hydraulic power generation (non-pumping), hydraulic power generation (pumping), thermal power generation (natural gas), thermal power generation (petroleum), thermal power generation (coal), and nuclear power generation.

The electric power generator 12 performs electric power control so as to give an electric power generation amount corresponding to the total electric power adjustment parameter transmitted from the electric power retail management apparatus 2, and supplies the generated electric power to the electric power transmission-distribution network 4. The electric power generator 12 outputs information on the present electric power generation amount and the maximum electric power generation amount to the electric power retail management apparatus 2. Using these pieces of information, the electric power retail management apparatus 2 generates the total electric power adjustment parameter and transmits it to each electric power generator 12 via the communication network 5.

When the electric power generator 12 is an electric power generator that performs solar power generation or wind power generation, the electric power generator 12 includes a storage device. In this case, the electric power generator 12 stores part of the generated electric power in the storage device, thereby adjusting the generated electric power to be supplied to the electric power transmission-distribution network 4. Examples of the storage device may include battery type storage devices and compressed-air type storage devices. For example, the compressed-air type storage device generates compressed air using generated electric power by solar power generation, stores the compressed air in a tank, and then rotates a turbine with the stored compressed air, thereby generating electric power.

When the electric power generator 12 is an electric power generator that performs solar power generation or wind power generation, the electric power generator 12 also can control the electric power generation amount by changing the direction of solar light panels or control the electric power generation amount by changing the direction of rotors (propellers) of windmills.

3. Electric Power Retail Management Apparatus 2

Figures 3, 4:
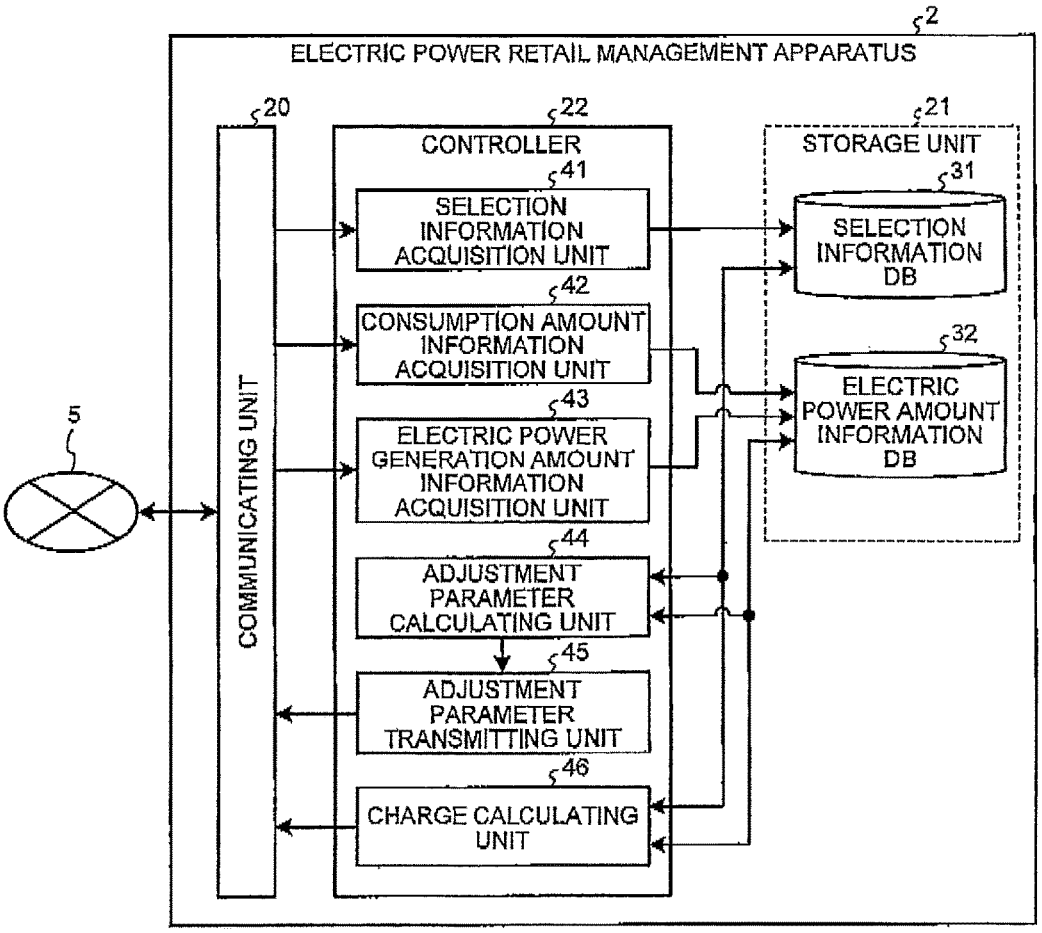
FIG. 3 is a diagram illustrating an example of the configuration of an electric power retail management apparatus according to the embodiment.
FIG. 4 is a diagram illustrating an example of a selection information table.

Next, the electric power retail management apparatus 2 according to the embodiment is described. FIG. 3 is a diagram illustrating an example of the configuration of the electric power retail management apparatus 2 according to the embodiment. As illustrated in FIG. 3, the electric power retail management apparatus 2 includes a communicating unit 20, a storage unit 21, and a controller 22. The controller 22 of the electric power retail management apparatus 2 according to the embodiment creates the above electric power supply-demand plan, which is omitted to be described below.

The communicating unit 20 is a communication interface that performs transmission and reception of information with the communication network 5 and connects with the communication network 5 by wired or wireless means. The controller 22 can transmit/receive various types of information to/from the electric power transmission-distribution network management apparatus 3, the smart meter 11 of the electric power customer facility 6, and the electric power generator 12 through the communicating unit 20 and the communication network 5.

The storage unit 21 includes a selection information data base (DB) 31 and en electric power amount information DB 32. For example, the selection information DB 31 and the electric power amount information DB 32 are a semiconductor memory device such as a random access memory (RAM) and a flash memory or a storage device such as a hard disk and an optical disc.

The controller 22 performs retailing electric power management processing. For example, the controller 22 includes an integrated circuit such as an application specific integrated circuit (ASIC) and a field programmable gate array (FPGA). The controller 22 executes a computer program stored in an internal storage device with an internal central processing unit (CPU) or micro processing unit (MPU) using a RAM as a work area, thereby functioning as a selection information acquisition unit 41, a consumption amount information acquisition unit 42, an electric power generation amount information acquisition unit 43, an adjustment parameter calculating unit 44, an adjustment parameter transmitting unit 45, and a charge calculating unit 46.

The configuration of the controller 22 is not limited to the configuration and may be another configuration so long as it performs information processing described below. The electric power retail management apparatus 2 includes a reading device (not illustrated). The controller 22 loads a computer program stored in a storage medium into the internal storage device through the reading device, and then executes the program, thereby achieving the above functions of the controller 22. Examples of the storage medium may include optical discs, flexible disks, and hard disks.

3.1. Selection Information Acquisition Unit 41

The selection information acquisition unit 41 acquires selection information set by the electric power customer CD from the smart meter 11 of the electric power customer CD to update a selection information table stored in the selection information DB 31. For example, the selection information includes information on user ID, contract capacity, contract type, and region.

FIG. 4 is a diagram illustrating an example of the selection information table. As illustrated in FIG. 4, the selection information table is information that associates a "user ID", a "contract capacity", a "contract type", and a "region" with each other. The "user ID" is identification information for the electric power customer CD. The "contract capacity" is the upper limit of electric power consumption. The "contract type" is information corresponding to the type of the electric power generator 12. The "region" indicates a region of the electric power customer CD and is a region corresponding to each electric power transmission-distribution network 4 in this example. For example, the region "EA" indicates that the electric power customer facilities 6 therein are connected to the electric power transmission-distribution network 4*a*, whereas the region "EB" indicates that the electric power customer facilities 6 therein are connected to the electric power transmission-distribution network 4*b*, for example.

The selection information table illustrated in FIG. 4 indicates that the electric power customer CD corresponding to the user ID "U 101 " exists in the region "EA" and makes an electric power retailing contract with a contract capacity of "10 amperes" and a contract type of "only solar power generation" with the electric power retailer CA. The selection information table also indicates that the electric power customer CD corresponding to the user ID "U102" exists in the region "EA" and makes an electric power retailing contract with a contract capacity of "30 amperes" and a contract type of "only natural energy" with the electric power retailer CA.

The selection information table also indicates that the electric power customer CD corresponding to the user ID "U 103 " exists in the region "EB" and makes an electric power retailing contract with a contract capacity of "20 amperes" and a contract type of "50% of natural energy and 50% of thermal power generation" with the electric power retailer CA. The selection information table also indicates that the electric power customer CD corresponding to the user ID "U 104 " exists in the region "EB" and makes an electric power retailing contract with a contract capacity of "40 amperes" and a contract type of "electric power charge plan A" with the electric power retailer CA. "Electric power charge plan A" is a charge plan that uses electric power from the lowest-cost electric power generator 12. With this charge plan, thermal power generation and nuclear power generation are combined to supply electric power, for example.

The selection information acquisition unit 41 updates the selection information table each time it receives the selection information from the smart meter 11. With this configuration, the latest selection information between the electric power retailer CA and the electric power customer CD is set in the selection information table.

3.2. Consumption Amount Information Acquisition Unit 42

The consumption amount information acquisition unit 42 acquires information on the electric power consumption amounts of the respective electric power customers CD from the respective smart meters 11 through the communication network 5 to update an electric power consumption table of the electric power amount information DB 32.

FIG. 5 is a diagram illustrating an example of the electric power consumption amount table. As illustrated in FIG. 5, the electric power consumption amount table includes information that associates information on the "user ID", a "this-time electric power consumption amount", and a "last electric power consumption amount" with each other. Although not illustrated, the electric power consumption amount table also includes information on an electric power consumption amount before last and former electric power consumption amounts.

The information on the electric power consumption amount set in the electric power consumption amount table is information integrated for each given period TA (e.g., 30 minutes). The "last electric power consumption amount" is an electric power consumption amount of the electric power customer CD in the last given period TA, whereas the "this-time electric power consumption amount" is an integrated value of the electric power customer CD after the elapse of the last given period TA until the present.

3.3. Electric Power Generation Amount Information Acquisition Unit 43

The electric power generation amount information acquisition unit 43 acquires information on electric power generation amounts and maximum electric power generation amounts of the respective electric power generators 12 from the respective electric power generators 12 through the communication network 5 to update an electric power generation amount table of the electric power amount information DB 32.

FIG. 6 is a diagram illustrating an example of the electric power generation amount table. As illustrated in FIG. 6, the electric power generation amount table includes information that associates information on an "electric power generator ID", a "power producer", the "region", a "type of electric power generator", a "contract electric power generation amount", an "electric power generation amount", a "maximum electric power generation amount", and an "electric power generation charge" with each other.

The "electric power generator ID" is identification information for the electric power generator 12, and the "power producer" is information on the power producer CE. The "region" is information on the region in which the electric power generator 12 exists and is a region corresponding to each electric power transmission-distribution network 4 in this example. The region "EA" indicates that the electric power generator 12 is connected to the electric power transmission-distribution network 4*a*, the region "EB" indicates that the electric power generator 12 is connected to the electric power transmission-distribution network 4*b*, and the region "EC" indicates that the electric power generator 12 is connected to the electric power transmission-distribution network 4*c*, for example.

The "contract electric power generation amount" is an electric power generation amount set in a contract between the electric power retailer CA and the power producer CE. For the electric power generator 12 with the electric power generator ID "E101" illustrated in FIG. 6, for example, a minimum contract electric power generation amount is set to be 1 MW/h, and a maximum contract electric power generation amount is set to be 2 MW/h. The minimum contract electric power generation amount is the minimum electric power generation amount requested from the electric power retail management apparatus 2 to the electric power generator 12, and the maximum contract electric power generation amount is the upper limit of an electric power generation amount requested from the electric power retail management apparatus 2 to the electric power generator 12. The power producer CE that has the electric power generator 12 that incapable of responding to a request of the maximum contract electric power generation amount from the electric power retail management apparatus 2 is asked for the payment of a penalty by the electric power retailer CA.

The "type of electric power generator" is information indicating the type of the electric power generator 12. Information on the "electric power generator ID", the "power producer", the "region", the "type of electric power generator", and the "contract electric power generation amount" is, after a contract is made between the electric power retailer CA and the power producer CE, set in the electric power generation amount table by the electric power retailer CA, for example. The "electric power generation amount" is information on an electric power generation amount in the given period TA and is information on the electric power generation amount the controller 22 requests from each electric power generator 12 through the total electric power adjustment parameter. The "maximum electric power generation amount" is the maximum electric power generation amount each electric power generator 12 can generate in the next given period TA. The "electric power charge" is a purchase charge of generated electric power per kilowatt.

3.4. Adjustment Parameter Calculating Unit 44

The adjustment parameter calculating unit 44 calculates the total electric power adjustment parameter for each electric power generator 12 on the basis of the conditions of the electric power generation amount of the electric power generators 12 and the electric power consumption amount of the electric power customers CD existing in the same region E while performing the balancing control on the basis of the selection information table, the electric power consumption amount table, and the electric power generation amount table.

The balancing control is a selection that equalizes the total amount of the electric power generation amounts of the electric power generators 12 of the power producers CE1 to CEm and the total amount of the electric power consumption amounts of the electric power customers CD1 to CDn per given period TA. The adjustment parameter calculating unit 44 predicts the total amount of the electric power consumption amounts in the next given period TA on the basis of the total amount of the electric power consumption amounts in the present given period TA, thereby performing the balancing control. It is not necessary for the total amount of the electric power generation amounts and the total amount of the electric power consumption amounts to be strictly the same amount; the total amount of the electric power generation amounts may be larger than the total amount of the electric power consumption amounts.

The adjustment parameter calculating unit 44 selects one or more electric power generators 12 corresponding to the selection information from the electric power generators 12 for each electric power customer CD as the electric power generators 12 that supplies electric power corresponding to the electric power consumption amount of each electric power customer CD, with preference given to the electric power generators 12 existing in the same region E as the electric power customer CD.

The adjustment parameter calculating unit 44 assigns the respective electric power generators 12 to the respective electric power customers CD with the "minimum electric power generation amount" as a lower limit and with the "maximum electric power generation amount" as an upper limit. The difference between the "electric power generation amount" and the "maximum contract electric power generation amount" in the electric power generation amount table is a reserve electric power amount. An increase in the electric power consumption amounts of the electric power customers CD can be compensated with the electric power generation amount equivalent to the reserve electric generation amount. The adjustment parameter calculating unit 44 also can assign the electric power generator 12 having the "maximum electric power generation amount" larger than the "maximum contract electric power generation amount" to the electric power customers CD with the "maximum electric power generation amount" as an upper limit. For the electric power generation amount exceeding the "maximum contract electric power generation amount", an electric power charge higher than a normal charge is set.

When the balancing control cannot be performed due to the presence of the electric power generator 12 that is incapable of ensuring the "minimum electric power generation amount", for example, the adjustment parameter calculating unit 44 can perform assignment of the electric power customers CD with the "maximum electric power generation amount" exceeding the "maximum contract electric power generation amount" as an upper limit.

The selection information table is in the condition illustrated in FIG. 4, the electric power consumption amount table is in the condition illustrated in FIG. 5, and the electric power generation amount table is in the condition illustrated in FIG. 6. In this case, the adjustment parameter calculating unit 44 assigns the generated electric power of the electric power generator 12 that performs solar power generation to the electric power customer CD with the user ID "U101", for example.

For example, the electric power generator 12 that performs solar power generation is the electric power generators 12 with the electric power generator IDs "E101", "E106", and "E108". Among these electric power generators 12, the generated electric power of one or more electric power generators 12 existing in the same region E as the electric power customer CD with the user ID "U 101 " is preferentially assigned to the electric power customer CD with the user ID "U101".

The electric power generator 12 with the electric power generator ID "E101" exists in the region "EA" and the electric power generators 12 with the electric power generator IDs "E106" and "E108" exist in the region "EB". The electric power customer CD with the user ID "U101" exists in the region "EA". Thus, the adjustment parameter calculating unit 44 assigns the electric power generator 12 with the electric power generator ID "E101" preferentially to the electric power customer CD with the user ID "U101". When the entire electric power generation amount of the electric power generator 12 with the electric power generator ID "E101" is assigned to the other electric power customers CD, the adjustment parameter calculating unit 44 assigns the electric power generator 12 having a margin in the electric power generation amount among the electric power generators 12 with the electric power generator IDs "E106" and "E108" to the electric power customer CD with the user ID "U101".

For example, the adjustment parameter calculating unit 44 assigns the electric power generation amounts of the electric power generators 12 that perform solar power generation, wind power generation, and hydraulic power generation (non-pumping) to the electric power customer CD with the user ID "U102". For example, the adjustment parameter calculating unit 44 assigns the electric power generation amounts of the electric power generators 12 with the electric power generator IDs "E101" to "E103" existing in the same region "EA" as the electric power customer CD with the user ID "U 102 " among the electric power generators 12 with the electric power generator IDs "E101" to "E103", "E106", and "E108" preferentially to the electric power customer CD with the user ID "U102". The adjustment parameter calculating unit 44 can assign one whose electric power generation charge is lower among the electric power generators 12 with the electric power generator IDs "E101" to "E103" preferentially to the electric power customer CD with the user ID "U102".

For example, the adjustment parameter calculating unit 44 assigns an electric power generation amount preferentially to the electric power customer CD with the user ID "U103". The electric power generation amount assigned includes the electric power generation amount of the electric power generator 12 that performs natural energy power generation of 50% and the electric power generation amount of the electric power generator 12 that performs thermal power generation of 50% and of the electric power generators 12 existing in the same region "EB" as the electric power customer CD with the user ID "U103". Examples of natural energy power generator may include solar power generation, wind power generation, and hydraulic power generation (non-pumping). Examples of thermal power generation may include thermal power generation (natural gas), thermal power generation (Petroleum), and thermal power generation (coal).

For example, the adjustment parameter calculating unit 44 assigns generated electric power with the lowest electric power generation charge preferentially to the electric power customer CD with the user ID "U 104 " on the basis of the electric power generation amount table. For example, the adjustment parameter calculating unit 44 assigns the generated electric power by the electric power generator 12 that exists in the same region "EB" as the electric power customer CD with the user ID "U 104 " and whose electric power generation charge is lowest preferentially to the electric power customer CD with the user ID "U104". The adjustment parameter calculating unit 44 considers the extra charge added for each of the connecting devices 8*a*, 8*b* to assign the electric power generator 12 with no extra charge preferentially to the electric power customers CD.

Thus, the adjustment parameter calculating unit 44 assigns the electric power generators 12 and the electric power generation amounts to the electric power customers CD on the basis of the conditions of the electric power generation amount and the electric power consumption amount of each type of the electric power generators 12 selected by the electric power customers CD and each region E while balancing the total amount of the electric power consumption amounts and the total amount of the electric power generation amounts in total by referring to the selection information table, the electric power consumption amount table, and the electric power generation amount table.

The adjustment parameter calculating unit 44 calculates the total electric power adjustment parameter for adjusting the electric power generation amount of each electric power generator 12 for each given period TA on the basis of information on the thus-assigned electric power generators 12 and electric power generation amounts. The total electric power adjustment parameter is information for designating an electric power generation amount in the next given period TA.

When each electric power customer CD does not specify the type of the electric power generator 12, the adjustment parameter calculating unit 44 can calculate the total electric power adjustment parameter for each electric power generator 12 regardless of the type of the electric power generator 12 on the basis of the conditions of the electric power generation amount and the electric power consumption amount of each region E.

The adjustment parameter calculating unit 44 assigns the electric power generator 12 and the electric power generation amount to each electric power customer CD and calculates the total electric power adjustment parameter in units of the given period TA. The electric power customer CD then transmits the selection information in units of the given period TA from the smart meter 11 to the electric power retail management apparatus 2, thereby providing generated electric power of the type that meets the demand of the electric power customer CD in units of the given period TA.

When the electric power generator 12 of the type corresponding to the selection information cannot be selected for a part of the electric power customers CD, the adjustment parameter calculating unit 44 assigns the electric power generator 12 not of the type corresponding to the selection information to such electric power customers CD, thereby performing the balancing control preferentially.

3.5. Adjustment parameter Transmitting Unit 45

The adjustment parameter transmitting unit 45 transmits the total electric power adjustment parameters of the respective electric power generators 12 generated by the adjustment parameter calculating unit 44 to the respective corresponding electric power generators 12.

3.6. Charge Calculating Unit 46

The charge calculating unit 46 calculates an electric power charge to be billed to each electric power customer CD on the basis of the information on the electric power consumption amounts of the respective electric power customers CD set in the electric power consumption amount table stored in the electric power amount information DB 32.

For the electric power customer CD for which the generated electric power (hereinafter denoted as non-selection generated electric power) of the electric power generator 12 not of the type corresponding to the selection information has been selected, the charge calculating unit 46 calculates a discount charge for the consumption of the non-selection generated electric power. The consumption amount of the non-selection generated electric power is stored in the electric power amount information DB 32 as an off-selection electric power consumption amount. The charge calculating unit 46 calculates an electric power charge corresponding to the off-selection electric power consumption amount.

When the electric power generator 12 having the "maximum electric power generation amount" larger than the "maximum contract electric power generation amount" is assigned to the electric power customer CD with the "maximum electric power generation amount" as the upper limit, the charge calculating unit 46 calculates an extra charge for an electric power generation amount exceeding the "maximum contract electric power generation amount". The extra charge can be an amount 0.5 to 1.0 time the "electric power charge" set in the electric power generation amount table. The electric power retailer CA pays the calculated extra charge to the corresponding power producer CE.

The charge calculating unit 46 calculates a penalty for the power producer CE corresponding to the electric power generator 12 that is incapable of supplying the "maximum contract electric power generation amount" to the electric power transmission-distribution network 4. The penalty can be an amount three to five times the "electric power charge" set in the electric power generation amount table. When the balancing control can be performed through the electric power generation amounts of the other electric power generators 12, the charge calculating unit 46 can set the penalty to be three times the "electric power charge", for example. When the balancing control cannot be performed, and the short electric power generation amount is supplied from the electric power generator of the electric power company CB to the electric power transmission-distribution network 4, the charge calculating unit 46 can set the penalty to be five times the "electric power charge", for example.

4. Processing Flow of Electric Power Retail Management Apparatus 2

Figure 7:
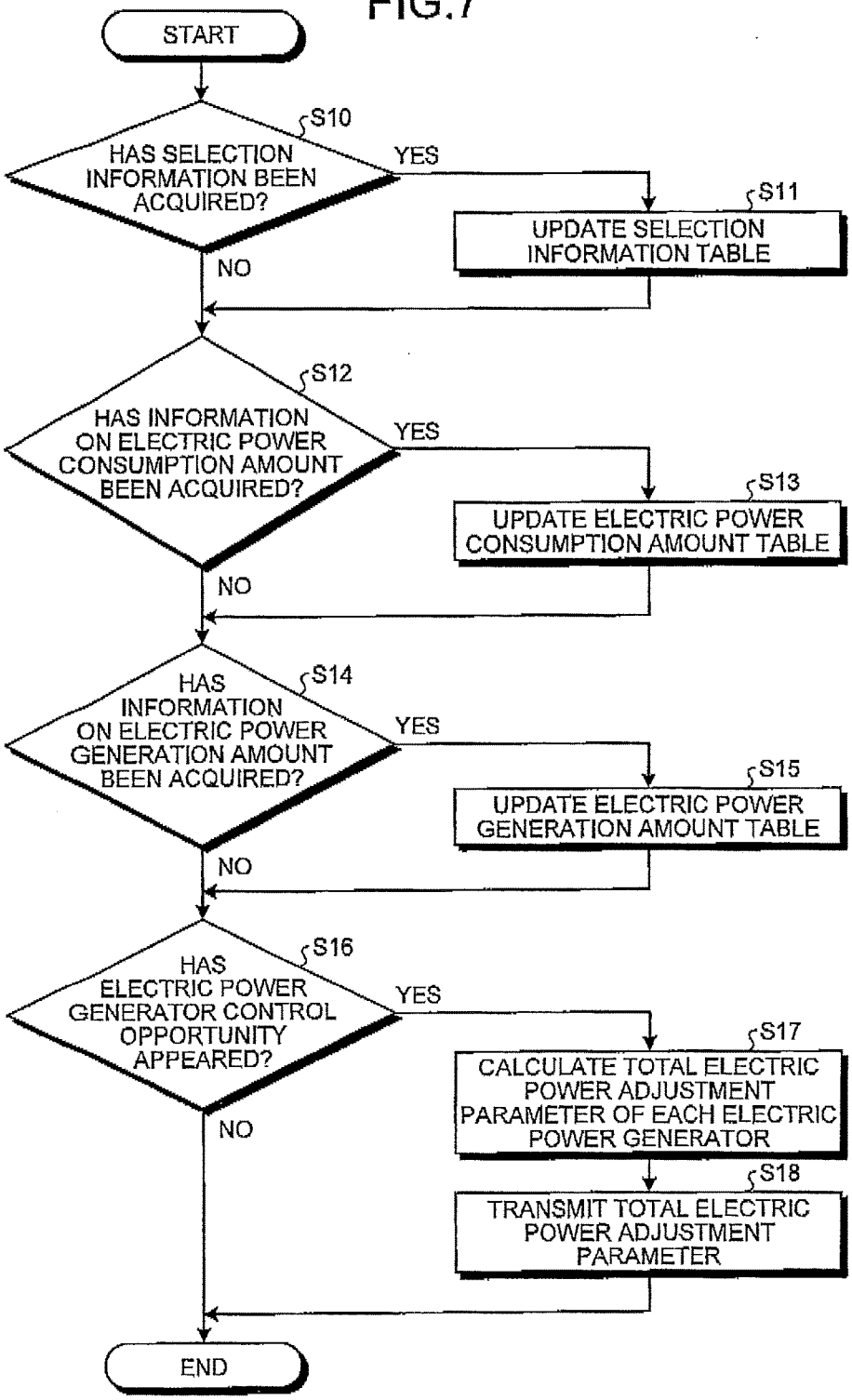
FIG. 7 is a flowchart illustrating an example of information processing of the electric power retail management apparatus according to the embodiment.

Described next is the procedure of information processing of the electric power retail management apparatus 2 according to the embodiment. FIG. 7 is a flowchart illustrating an example of the information processing of the electric power retail management apparatus 2 according to the embodiment. The operation is processing performed repeatedly by the controller 22 of the electric power retail management apparatus 2.

As illustrated in FIG. 7, the controller 22 of the electric power retail management apparatus 2 determines whether it has acquired selection information from the smart meter 11 of the electric power customer CD (Step S10). If the controller 22 determines that it has received the selection information (Yes at Step S10), the controller 22 updates the selection information table stored in the selection information DB 31 on the basis of the acquired selection information (Step S11).

After the end of the processing at Step S11 or if the controller 22 determines that it has not acquired the selection information (No at Step S10), the controller 22 determines whether it has acquired electric power consumption amount information from the smart meter 11 of the electric power customer CD (Step S12). If it determines that it has acquired the electric power consumption amount information (Yes at S12), the controller 22 updates the electric power consumption amount table stored in the electric power amount information DB 32 on the basis of the acquired electric power consumption amount information (Step S13).

After the end of the processing at Step S13 or if the controller 22 determines that it has not acquired the electric power consumption amount information (No at Step S12), the controller 22 determines whether it has acquired electric power generation amount information from the electric power generator 12 (Step S14). If it determines that it has acquired the electric power generation amount information (Yes at S14), the controller 22 updates the electric power generation amount table stored in the electric power amount information DB 32 on the basis of the acquired electric power generation amount information (Yes at S15).

After the end of the processing at Step S15 or if the controller 22 determines that it has not acquired the electric power generation amount information (No at S14), the controller 22 determines whether an electric power generator control opportunity has appeared (Step S16). For example, the electric power generator control opportunity is set at timing before the elapse of the present given period TA and when the electric power generator 12 can supply generated electric power corresponding to the total electric power adjustment parameter to the electric power transmission-distribution network 4 in the next given period TA.

If the controller 22 determines that the electric power generator control opportunity has appeared (Yes at S16), the controller 22 assigns the electric power generator 12 and the electric power generation amount to each electric power customer CD, and on the basis of the result of the assignment, calculates the total electric power adjustment parameter corresponding to the total amount of each electric power generator 12 of the assigned electric power generation amount for each electric power generator 12 while maintaining the balancing control (Step S17). Next, the controller 22 transmits the total electric power adjustment parameter to the corresponding electric power generator 12 (Step S18).

After the end of the processing at Step S18 or if the controller 22 determines that the electric power generator control opportunity has not appeared at Step S16 (No at Step S16), the controller 22 ends the processing. The controller 22 calculates an electric power charge of each electric power customer CD and an electric power charge of each electric power generator 12 for each given period (e.g., every end of month) on the basis of the selection information table and the electric power consumption amount table.

5. Other Embodiments

Although the above-described embodiment can select one or more electric power generators 12 for each electric power customer facility 6, the smart meter 11 can select one or more electric power generators 12 for each device within the electric power customer facility 6. For example, a refrigerator may select the electric power generator 12 of solar power generation, whereas a lighting fixture and an electric fan may select the electric power generator 12 of wind power generation. In this case, on the basis of the selection information on each device within the electric power customer facility 6 transmitted from the smart meter 11, the adjustment parameter calculating unit 44 assigns one or more electric power generators 12 corresponding to the selection information among the electric power generators 12 to each electric power customer CD.

6. Effects

The electric power retail management apparatus 2 according to the embodiment includes the consumption amount information acquisition unit 42, the electric power generation amount information acquisition unit 43, the adjustment parameter calculating unit 44, and the adjustment parameter transmitting unit 45. The consumption amount information acquisition unit 42 acquires the information on the amounts of electric power amounts, as the information on the electric power generation amount, supplied from the electric power generators 12 of the respective power producers CE to the electric power transmission-distribution network 4. The electric power generation amount information acquisition unit 43 acquires the information on the electric power amounts, as the information on the electric power consumption amount, supplied from the electric power transmission-distribution network 4 to the respective electric power customers CD. The adjustment parameter calculating unit 44 calculates the total electric power adjustment parameter that balances the electric power generation amounts and the electric power consumption amounts in total for each electric power generator 12 on the basis of the conditions of the electric power generation amount of the electric power generators 12 and the electric power consumption amount of the electric power customers CD existing in the same region E. The adjustment parameter transmitting unit 45 transmits the total electric power adjustment parameter to the electric power generator 12.

With this configuration, the electric power retail management apparatus 2 appropriately manages the electric power generation-distribution path while performing the balancing control. For example, it can reduce the lengthening of the path between the electric power generator 12 and the facilities of the electric power customer CD and also can reduce spreading across the electric power transmission-distribution networks of different electric power companies CB, thereby reducing an increase in the cost of electric power transmission-distribution and reducing electric power transmission-distribution loss.

The adjustment parameter calculating unit 44 sets the region E corresponding to the electric power transmission-distribution network 4 to which the facilities of the electric power customers CD and the electric power generators 12 are each connected.

This reduces the spreading of the electric power transmission-distribution path across the electric power transmission-distribution networks 4 of different electric power companies CB while performing the balancing control, thereby appropriately managing the electric power transmission-distribution path.

The total electric power adjustment parameter for each electric power generator 12 is calculated on the basis of the conditions on the electric power generation amounts and the electric power consumption amounts of each region E corresponding to the type of the electric power generators selected by the electric power customers CD.

This constructs a virtual electric power transmission-distribution path between each electric power customer facility 6 and the electric power generators 12 of each power producer CE, thereby reflecting demands corresponding to the preference of the electric power customers CD. This can therefore provide an attractive electric power retailing service and increase the number of subscribers to the electric power retailing service.

The electric power retail management apparatus 2 according to the embodiment includes the charge calculating unit 46. The charge calculating unit 46 calculates the penalty for the power producer CE having the electric power generator 12 that is incapable of supplying an agreed electric power generation amount to the electric power transmission-distribution network 4. The agreed electric power generation amount is the "maximum contract electric power generation amount" set in the electric power generation amount table.

Thus, the penalty for the power producer CE having the electric power generator 12 that is incapable of supplying the agreed electric power generation amount to the electric power transmission-distribution network 4 is calculated, by which violations of the supply of the agreed electric power generation amount to the electric power transmission-distribution network 4 are expected to be reduced and the balancing control can be performed stably.

The electric power generation amount information acquisition unit 43 acquires the information on the reserve electric power amount of each electric power generator 12. When the adjustment parameter calculating unit 44 determines that the total amount of the electric power generation amounts is short due to the presence of the electric power generator 12 that is incapable of supplying the agreed electric power generation amount to the electric power transmission-distribution network 4, the adjustment parameter calculating unit 44 calculates the total electric power adjustment parameter so as to increase electric power to be supplied from the electric power generator 12 having the reserve electric power amount to the electric power transmission-distribution network 4. For example, the reserve electric power amount is the difference between the "electric power generation amount" and the "maximum contract electric power generation amount" in the electric power generation amount table.

With this configuration, the balancing control can be performed stably even when there is the electric power generator 12 that is incapable of supplying the agreed electric power generation amount to the electric power transmission-distribution network 4 appears.

7. Others

The electric power retail management apparatus 2 may change its configuration flexibly; it may be implemented with a plurality of server computers and some functions may be implemented so as to call up an external platform or the like through an application programming interface (API) or network computing, for example.

One aspect of the embodiment can provide an electric power retail management apparatus and an electric power retailing management method that can appropriately manage an electric power transmission-distribution path while performing balancing control.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An electric power retail management apparatus in communication with a plurality of electric power generators of power producers and a plurality of electric power customer facilities over a. network, the plurality of electric power generators and the plurality of electric power customer facilities existing in an area including a plurality of regions, the electric power retail management apparatus comprising:

a memory storing: (i) a first information indicating a region in which each of the plurality of electric power generators is located, (ii) a second information indicating a region in which each of the plurality of electric power customer facilities is located, and (iii) a third information indicating an electric power consumption amount of each of the plurality of electric power customer facilities; and a processor operatively coupled to the memory, the processor being programmed to:

acquire information on an electric power generation amount of each of the plurality of electric power generators in a future predetermined time period from the plurality of electric power generators via the network;

acquire information on an electric power consumption amount of each of the plurality of electric power customer facilities from the plurality of electric power customer facilities via the network, and update the third information stored in the memory based on the acquired information on the electric power consumption amount, the electric power consumption amount being an amount of electric power provided to the corresponding electric power customer facility;

predict an electric power consumption amount of each of the plurality of electric power customer facilities during the future predetermined time period based on the third information stored in the memory:

allocate at least one of the plurality of electric power generators to each of the plurality of electric power customer facilities based on the first information and the second information stored in the memory, such that at least one electric power generator existing in a same region as each of the electric power customer facilities is preferentially allocated to a corresponding one of the electric power customer facilities;

calculate a total electric power adjustment parameter for each of the plurality of electric power generators based on the result of the allocation so that a total of the electric power generation amounts of the plurality of electric power generators is equal to or greater than a total of the predicted electric power consumption amounts of the plurality of electric power customer facilities, the total electric power adjustment parameters being based on the predicted electric power consumption amounts of the plurality of electric power customer facilities and the electric power generation amounts of the plurality of electric power generators; and transmit the total electric power adjustment parameters to the plurality of electric power generators, respectively, in order to control the electric power generation amounts generated by each of the plurality of the electric power generators to each of the corresponding plurality of electric power customer facilities based on the total electric power adjustment parameters.

2. The electric power retail management apparatus according to claim 1, wherein the processor is programmed to set the plurality of regions corresponding to the electric power transmission-distribution network to which the electric power customer facilities and the electric power generators are each connected.

3. The electric power retail management apparatus according to claim 1, wherein the processor is programmed to calculate the total electric power adjustment parameter for each electric power generator based on the electric power generation amounts and the electric power consumption amounts of each region of the plurality regions corresponding to a type of the electric power generators allocated to each electric power customer facility.

4. The electric power retail management apparatus according to claim 1, wherein the processor is programmed to calculate a penalty for a power producer having one of the plurality of electric power generators that is incapable of supplying an electric power generation amount to the electric power transmission-distribution network to satisfy the predicted electric power consumption amount for a corresponding electric power customer facility.

5. The electric power retail management apparatus according to claim 4, wherein the processor is programmed to:

acquire information on an amount of reserve electric power of each of the electric power generators; and when the calculated total amount of the electric power generation amount is less than the total of the predicted electric power consumption amounts of the plurality of electric power customer facilities, calculate the total electric power adjustment parameter so as to increase electric power to be supplied from each of the electric power generators having the amount of reserve electric power to the electric power transmission-distribution network.

6. An electric power retailing management method executed by a computer, the computer being in communication with a plurality of electric power generators of power producers and a plurality of electric power customer facilities over a network, the plurality of electric power generators and the plurality of electric power customer facilities existing in an area including a plurality of regions, the method comprising:

storing in a memory: (i) a first information indicating a region in which each of the plurality of electric power generators is located, (ii) a second information indicating a region in which each of the plurality of electric power customer facilities is located, and (iii) a third information indicating an electric power consumption amount of each of the plurality of electric power customer facilities;

acquiring information on an electric power generation amount of each of the plurality of electric power generators in a future predetermined time period from the plurality of electric power generators via the network;

acquiring information on an electric power consumption amount of each of the plurality of electric power customer facilities from the plurality of electric power customer facilities via the network, and update the third information stored in the memory based on the acquired information on the electric power consumption amount, the electric power consumption amount being an amount of electric power provided to the corresponding electric power customer facility:

predicting an electric power consumption amount of each of the plurality of electric power customer facilities during the future predetermined time period based on the third information stored in the memory;

allocating at least one of the plurality of electric power generators to each of the plurality of electric power customer facilities base on the first information and the second information stored in the memory, such that at least one electric power generator existing in a same region as each of the electric power customer facilities is preferentially allocated to a corresponding one of the electric power customer facilities;

calculating a total electric power adjustment pararmeter for each of the plurality of electric power generators based on the result of the allocation so that a total of the electric power generation amounts of the plurality of electric power generators is equal to or greater than a total of the predicted electric power consumption amounts of the plurality of electric power customer facilities, the total electric power adjustment parameters being based on the predicted electric power consumption amounts of the plurality of electric power customer facilities and the electric power generation amounts of the plurality of electric power generators; and transmitting the total electric power adjustment parameters to the plurality of electric power generators, respectively, in order to control the electric power generation amounts generated by each of the plurality of the electric power generators to each of the corresponding plurality of electric power customer facilities based on the total electric power adjustment parameters.

7. The electric power retail management method according to claim 6, wherein the calculating includes setting the plurality of regions corresponding to the electric power transmission-distribution network to which the electric power customer facilities and the electric power generators are each connected.

8. The electric power retail management method according to claim 6, wherein the calculating includes calculating the total electric power adjustment parameter for each electric power generator based on the electric power generation amounts and the electric power consumption amounts of each region of the plurality of regions corresponding to a type of the electric power generators allocated to each electric power customer facility.

9. The electric power retail management method according to claim 6, further comprising calculating a penalty for a power producer having one of the plurality of electric power generators that is incapable of supplying an electric power generation amount to the electric power transmission-distribution network to satisfy the predicted electric power consumption amount for a corresponding electric power customer facility.

10. The electric power retail management method according to claim 9, wherein:

acquiring the information on the electric power generation amount includes acquiring information on an amount of reserve electric power of each of the electric power generators; and when the calculated total amount of the electric power generation amount is less than the total of the predicted electric power consumption amounts of the plurality of electric power customer facilities, calculating the total electric power adjustment parameters so as to increase electric power to be supplied from each of the electric power generators having the amount of reserve electric power to the electric power transmission-distribution network.

* * * * *